US008732981B2

(12) United States Patent
Cobb

(10) Patent No.: US 8,732,981 B2
(45) Date of Patent: May 27, 2014

(54) ECCENTRIC TOE-OFF CAM LEVER

(76) Inventor: John E. Cobb, Tyler, TX (US)

( * ) Notice: Subject to any disclaimer, the term of this patent is extended or adjusted under 35 U.S.C. 154(b) by 528 days.

(21) Appl. No.: 13/090,393

(22) Filed: Apr. 20, 2011

(65) Prior Publication Data

US 2012/0266500 A1 Oct. 25, 2012

(51) Int. Cl.
*A43B 13/12* (2006.01)

(52) U.S. Cl.
USPC ..... 36/25 R; 36/30 R

(58) Field of Classification Search
USPC ..... 36/110, 132, 142, 25 R, 180, 43, 94, 28, 36/88, 93, 117.6, 11.5, 117.7, 30 R
See application file for complete search history.

(56) References Cited

U.S. PATENT DOCUMENTS

| | | | | |
|---|---|---|---|---|
| 4,689,898 | A | 9/1987 | Fahey | |
| 5,384,973 | A | 1/1995 | Lyden | |
| 5,528,842 | A | 6/1996 | Ricci et al. | |
| 5,572,805 | A | 11/1996 | Giese et al. | |
| 5,918,338 | A | 7/1999 | Wong et al. | |
| 6,708,424 | B1 * | 3/2004 | Ellis, III | 36/25 R |
| 6,928,756 | B1 | 8/2005 | Haynes | |
| 6,944,972 | B2 | 9/2005 | Schmid | |
| 7,337,559 | B2 | 3/2008 | Russell | |
| 7,779,557 | B2 | 8/2010 | Teteriatnikov et al. | |
| 7,805,860 | B2 | 10/2010 | Fliri | |
| 2003/0188455 | A1 | 10/2003 | Weaver, III | |
| 2005/0268489 | A1 | 12/2005 | Austin | |
| 2006/0174515 | A1 | 8/2006 | Wilkinson | |
| 2007/0271817 | A1 * | 11/2007 | Ellis, III | 36/28 |
| 2010/0031530 | A1 | 2/2010 | Abshire | |

* cited by examiner

*Primary Examiner* — Ted Kavanaugh
(74) *Attorney, Agent, or Firm* — Eric C. Schmalbach

(57) ABSTRACT

A sole system which allows plantarflexion and dorsiflexion in the running/walking gait; provides a mechanical advantage through articulation of the forefoot to stimulate an upward plantar moment force during toe-off; and increases the distance per step without altering the stride pattern. An embodiment of the current invention has an eccentric toe-off cam lever ("cam lever") integrated into the midsole of a shoe. The cam lever of the embodiment includes: a distal longitudinally extending cam element; a forefoot fulcrum element; and a rear longitudinally extending cam element.

28 Claims, 14 Drawing Sheets

ECCENTRIC TOE-OFF CAM LEVER

BACKGROUND

The proposed invention relates to articles of footwear. More specifically, the invention relates to a sole system that integrates an eccentric toe-off cam lever ("cam lever") into footwear. The integrated cam lever allows for both plantarflexion and dorsiflexion; provides a mechanical advantage through articulation of the forefoot to stimulate an upward plantar moment force during toe-off; and increases the distance per step without altering the stride pattern.

During the running or walking gait ("gait"), the foot strikes the ground and rolls forward. The foot does not strike the ground flat, but forms contact with the ground on either the heel or toe. During this motion, the foot travels through heel strike, mid-stance, and toe-off.

Attempts have been made to increase the distance per step by selected modification of the natural biomechanics of the gait. One example of an alteration includes taking longer strides. "Over striding" involves placing the lead foot down on its heel and in front of the body; resulting in a breaking effect, both interrupting natural forward momentum and increasing ground contact time.

Mechanical adaptations have also been used to alter the gait by selected modifications to running shoes. The selected modifications alter the locomotion, bio-mechanic posture, and gait of the wearer. Unshod runners typically alter their running gait to a forefoot striking pattern, to avoid the harsh impact of heel first striking Shoe designs attempt to compensate for this by increasing the width, thickness, and impact absorbing properties of the heel of the shoe. As a result, shod runners may tend to heel strike.

At faster running paces, and during sprinting, the heel strike phase may be omitted, as the runner tends to elevate to the toes. Thick heels are not conducive to the cadence and biomechanics of the toe-striking pattern. Specifically, the thicker heels decrease the plantarflexion and dorsiflexion of the ankle, and relocate the center-of-gravity towards the rear of the shoe. In addition, the mechanics resulting from the natural anatomical design of the human foot is ignored, due to the ankles and lower leg muscles performing much of the bio-mechanical assistance during heel strike, mid-stance, and toe-off.

Attempts have been made to increase the orthotic benefits and/or cushioning of shoe designs. See for example, U.S. Pat. Nos. 5,572,805, 5,918,338, and 7,779,557. Additional attempts have been made to use the downward force of the runner. See for example: U.S. Pat. Nos. 4,689,898, 5,528,842, 6,928,756, 6,944,972, 7,337,559, and 7,788,824; and U.S. Patent Application Publication Nos. 2003/0188455, 2005/0268489, 2006/0174515, and 2010/0031530. Further attempts have been made to allow articulation of individual toes. See for example, U.S. Pat. Nos. 5,384,973, and 7,805,860. However, each of these designs suffers from one or more disadvantages. Therefore, a need arises for a sole system which allows plantarflexion and dorsiflexion of the ankle in the gait; provides a mechanical advantage through articulation of the forefoot to stimulate an upward plantar moment force during toe-off; and increases the distance per step without altering the stride pattern.

SUMMARY

The current invention is directed to an apparatus that solves the need for a sole system which allows plantarflexion and dorsiflexion in the gait; provides a mechanical advantage through articulation of the forefoot to stimulate an upward plantar moment force during toe-off; and increases the distance per step without altering the stride pattern. An embodiment of the current invention comprises an eccentric toe-off cam lever ("cam lever") integrated into the midsole of a shoe. The cam lever of the embodiment comprises: a distal longitudinally extending cam element; a forefoot fulcrum element; and a proximal longitudinally extending cam element.

It is an object of the current invention to increases the distance per step without altering the stride pattern.

It is another object of the current invention to incorporate a cam lever into the midsole of a shoe to increase the distance per step.

It is another object of the current invention to provide a mechanical advantage through articulation of the forefoot to stimulate an upward plantar moment force during toe-off.

It is another object of the current invention to incorporate a cam lever into the midsole of a shoe to allow plantarflexion and dorsiflexion in the running gait, without altering the stride pattern.

It is a further object of the current invention to incorporate a cam lever into the midsole of a shoe, such that the shape and offset center position provides a mechanical advantage through articulation of the forefoot to stimulate an upward plantar moment force during toe-off, and increases the distance per step without altering the stride pattern.

DESCRIPTION OF THE DRAWINGS

These and other features, aspects and advantages of the present invention will become better understood with regard to the following description, appended claims, and accompanying drawings where:

DESCRIPTION

Overview

Figure 21:
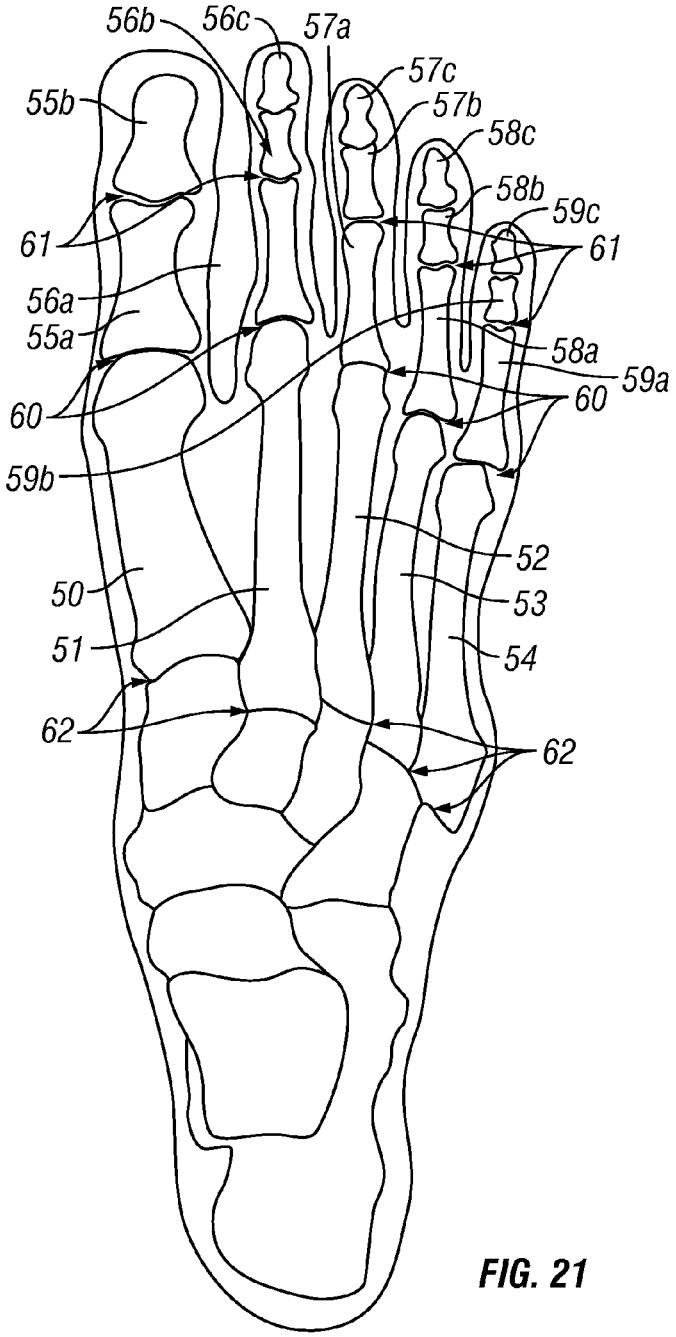
FIG. 21 shows a top view of the bones of the foot.
Figure 22:
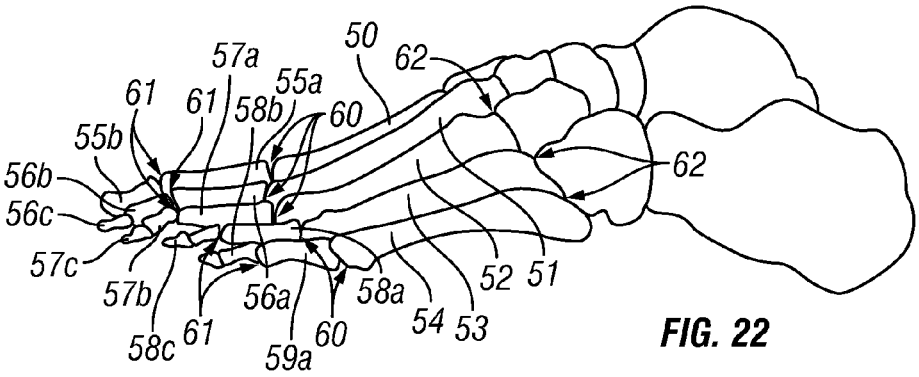
FIG. 22 shows a side view of the bones of the foot.

Articulation and utilization of the forefoot can provide a mechanical advantage, if properly used. While the relative structure of the forefoot may be used for balance and to maintain the arches of the foot, it may also be used to accentuate toe-off. The bones of the forefoot are comprised of the phalanges, or the bones of the five toes 55-59, and the five metatarsal bones 50-55, as shown in FIGS. 21, 22. The phalanges include: the bones of the big toe or hallux, consisting of the distal phalange of the hallux, 55*b*, and the proximal phalange of the hallux 55*a*; and the bones of the remaining four toes, consisting of the distal phalanx bones, 56*c*, 57*c*, 58*c*, 59*c*, the middle phalanx bones, 56*b*, 57*b*, 58*b*, 59*b*, and the proximal phalanx bones, 56*a*, 57*a*, 58*a*, 59*a*. The metatarsals 50-55, are five long bones extending across the middle portion of the foot and connecting with the respective phalanges. The joints between the phalanges are called interphalangeal joints 61, between the metatarsus and phalanges are called metatarsophalangeal joints 60, and those between the tarsus and metatarsus are called the tarsometatarsal joints, 62.

Figure 23:
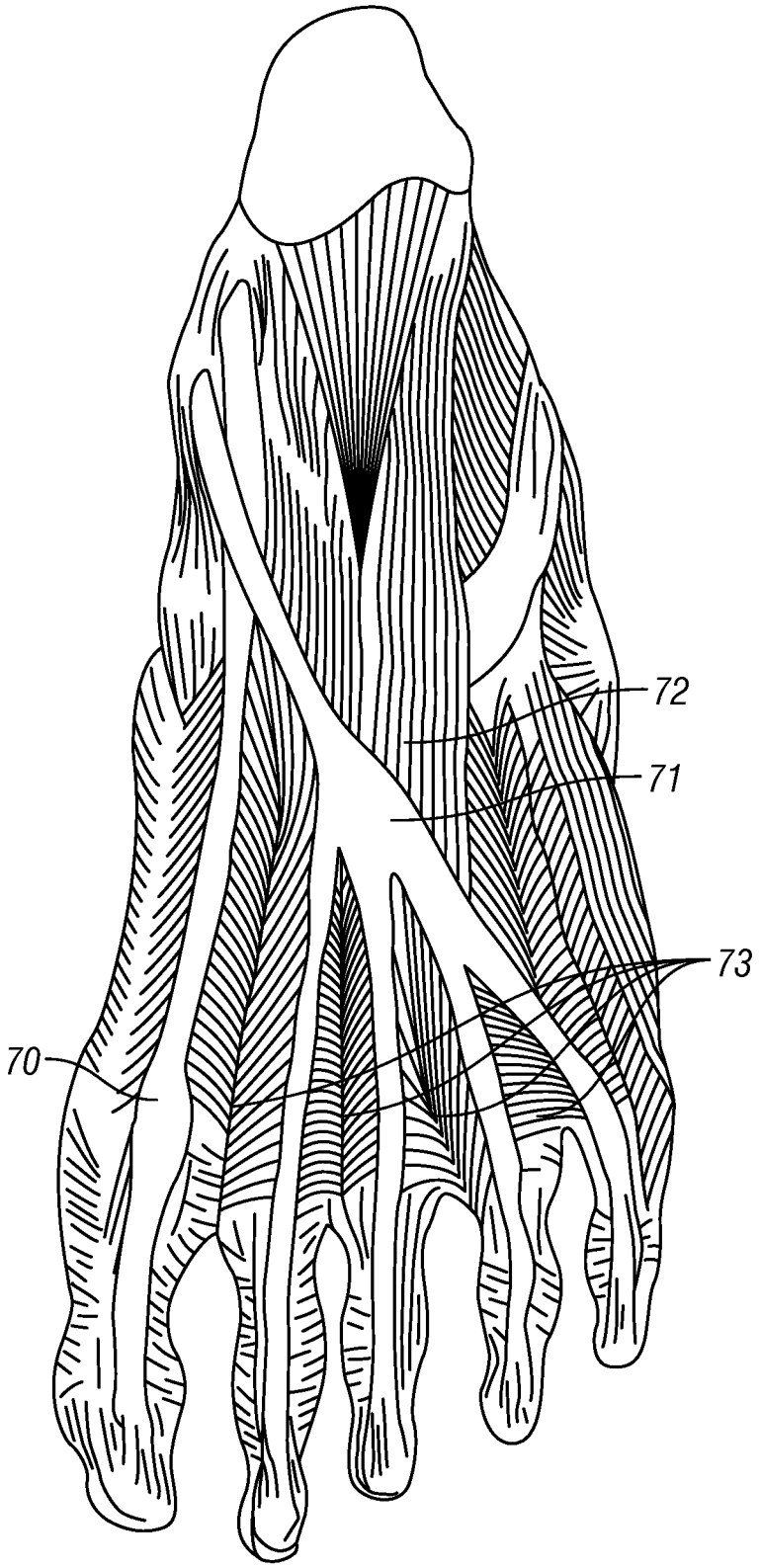
FIG. 23 shows a top view of the muscles of the foot.
Figure 24:
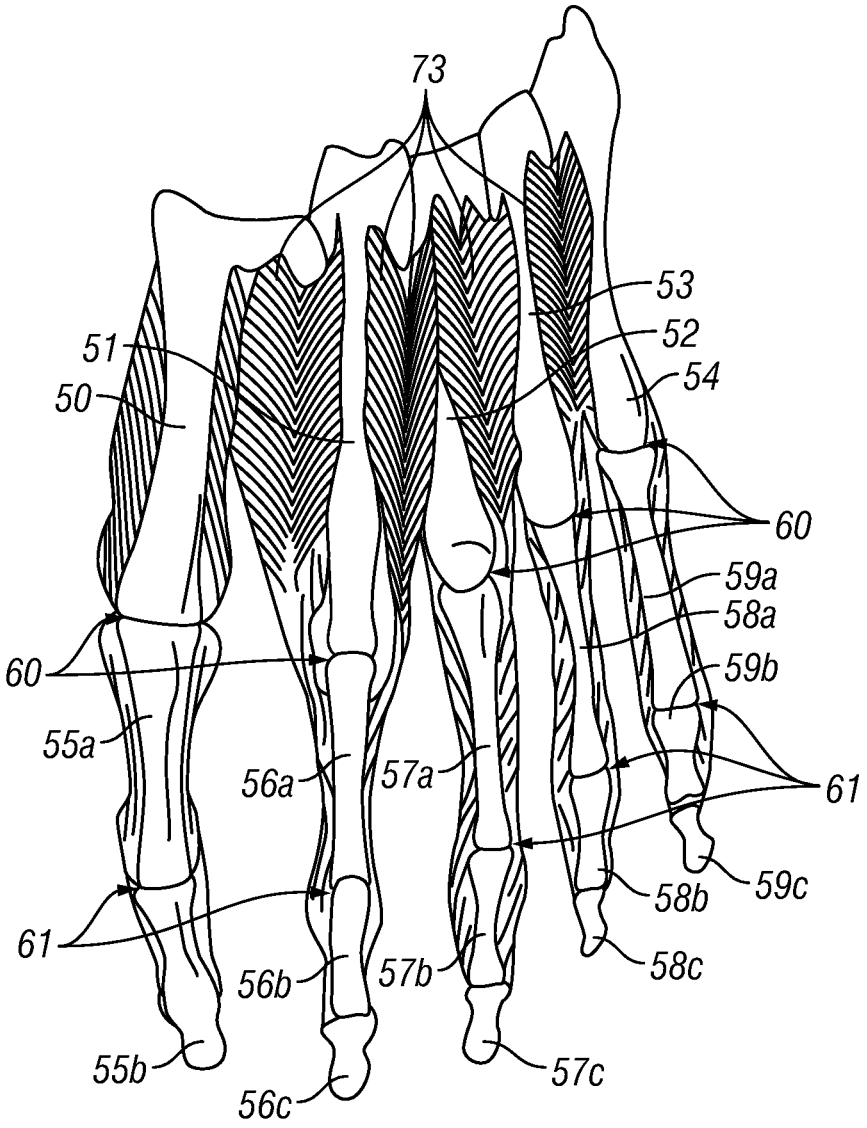
FIG. 24 shows a top view of the muscles of the forefoot.
Figure 25:
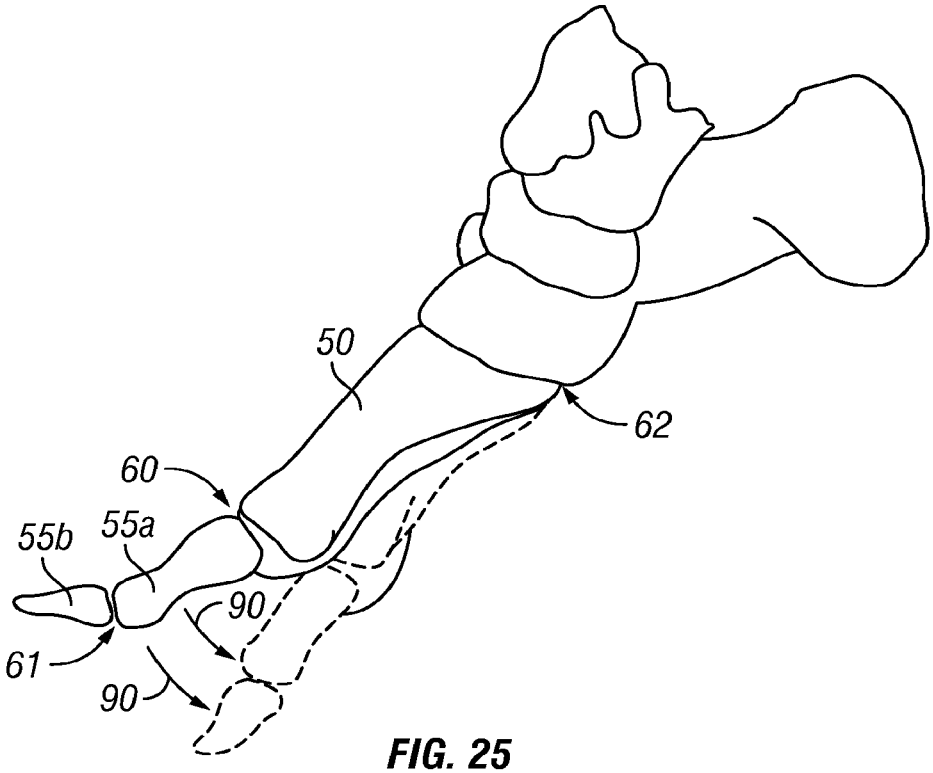
FIG. 25 shows a side view of the bones of the human foot, illustrating forefoot articulation.

The muscles and tendons of the foot are shown in FIGS. 23, 24. The toe flexors and extensors 73, provide frontal plane moments based on their lines of action. The instrinsic abductor and flexor muscles of the foot 72, 73, and the extensor tendons 70, 71, of the metatarsus can be used to selectively articulate the individual digits of the foot. The combination of such movements induces plantarflexion and dorsiflexion.

Figure 7:
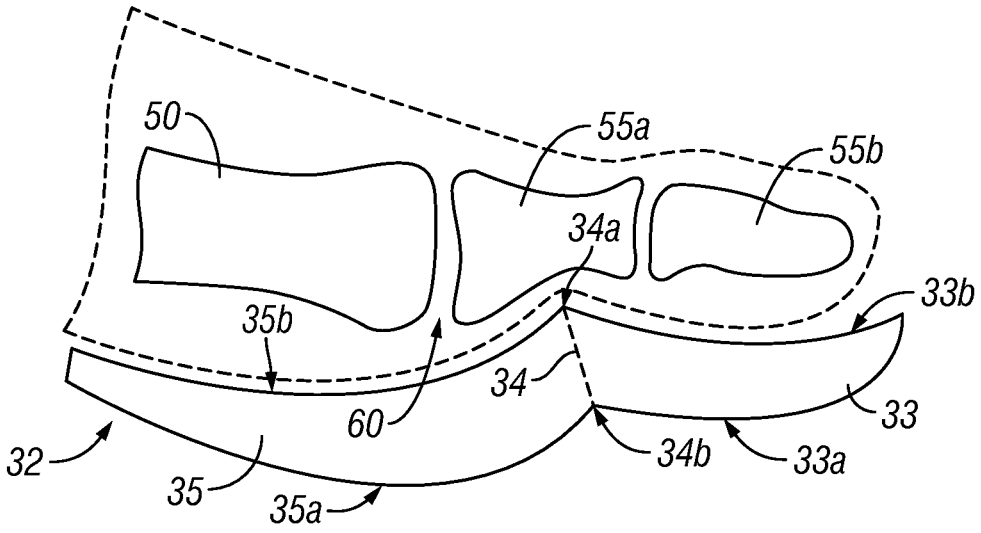
FIG. 7 shows a side sectional view of the cam lever of the embodiment of FIG. 1.
Figure 26:
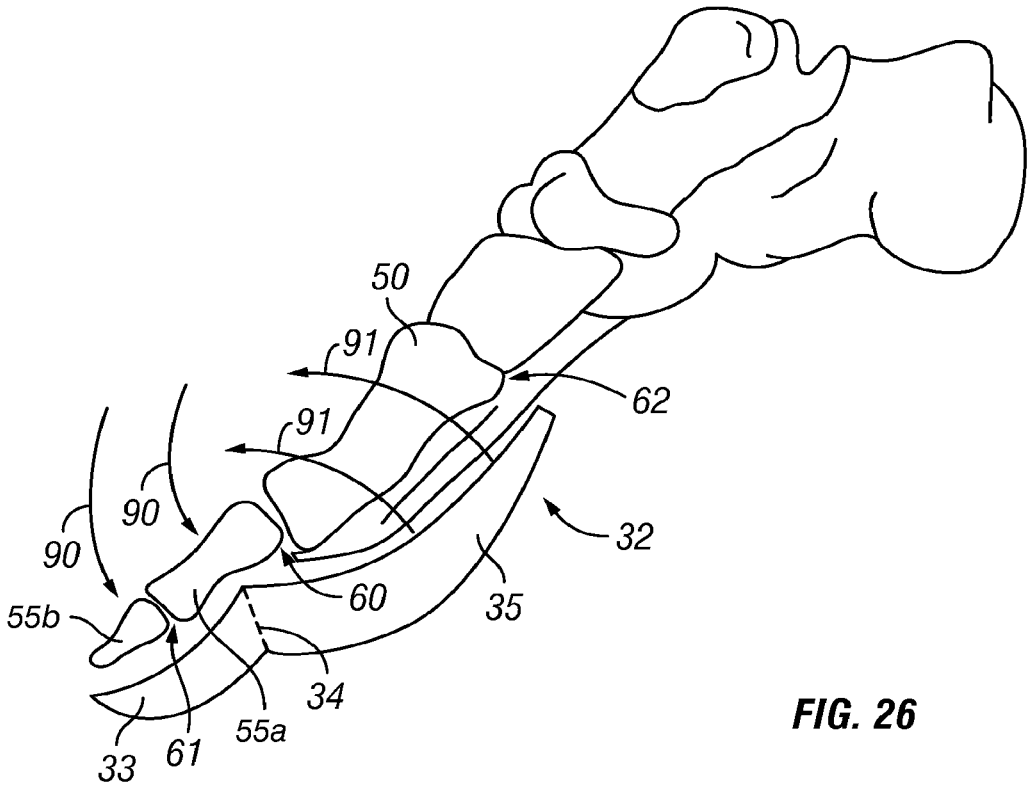
FIG. 26 shows a side view of the bones of the human foot, illustrating forefoot articulation in conjunction with the cam lever of the embodiment of FIG. 1, and the resulting upward plantar moment force.

The cam lever 32, of an embodiment of the current invention selectively isolates the muscles and tendons of the forefoot region to allow downward articulation. The downward articulation of the phalanges 55-59, and metatarsals 50-55, causes a downward moment force 90, to be applied relative to the frontal plane, as shown in FIG. 26. The cam lever 32, behaves as a modified simple lever, with lower cam surface and forefoot fulcrum element 34 positioned near the ball of the foot approximately distal and below the point where the individual phalanges 55-59, meet the respective metatarsals 50-55, at the metatarsophalangeal joints, 60, as illustrated in FIGS. 7, 26. The forefoot fulcrum element 34, provides the axis of rotation during forefoot articulation, allowing an upward plantar moment force 91, to be applied proximal to the frontal plane, and proximal to the forefoot fulcrum element 34, as shown in FIG. 26. The forefoot fulcrum element 34, provides a resting point for the plantar surface of the foot surrounding the area near the metatarsophalangeal joints 60, from which mechanical leverage can be achieved. The upward plantar moment force 91, is applied against the plantar portion of the foot. The resulting reaction causes the foot to rotate forward during toe-off, as shown in FIG. 26.

The cam lever 32, also serves as eccentric cam to assist in toe-off to increase the distance per step without altering the stride pattern. The shape and configuration of the cam lever contributes to this effect through the inclusion of one or more curvilinear convex portions 35*a*, 34*b*, 33*a*, as illustrated in FIGS. 1-7.

Figure 6:
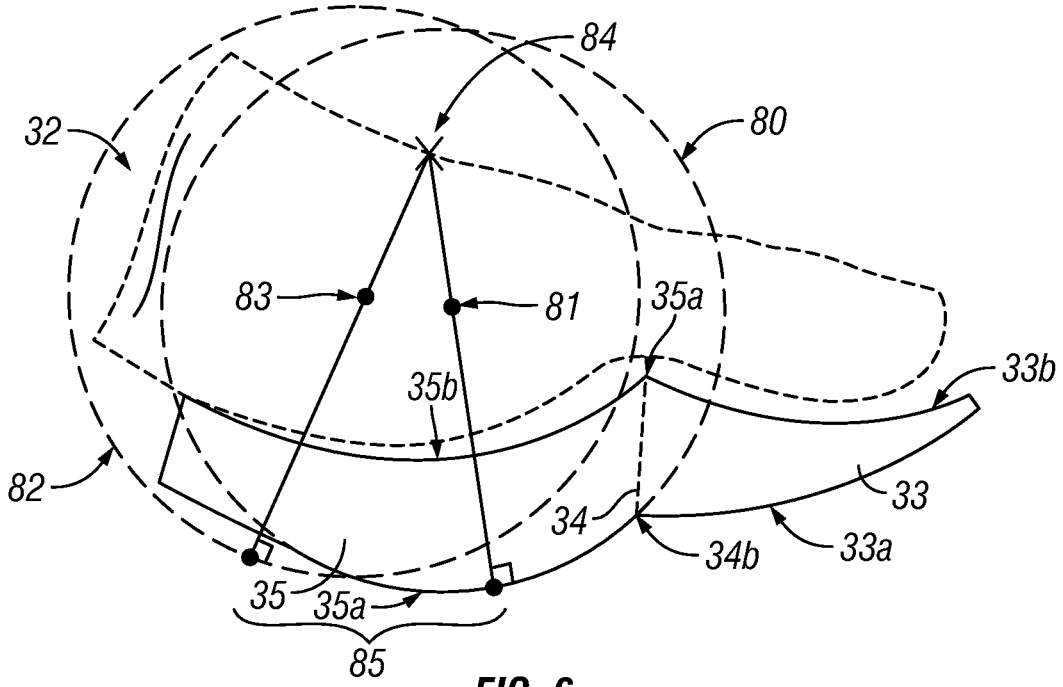
FIG. 6 shows a side sectional view of the cam lever of the embodiment of FIG. 1; illustrating the offset center position of the cam lever.

In toe-off (without use of embodiments of the current invention), the plantar surface of the ball of the foot is in contact with the ground. The foot rotates forward in a progressive radial orientation, respective to a plantar center point 83, located approximately above the ball of the foot, as illustrated in FIG. 6. The foot rotates in manner relative to the respective plantar center point 83, along a circular path 82, until the foot is no longer in contact with the ground.

Figure 20:
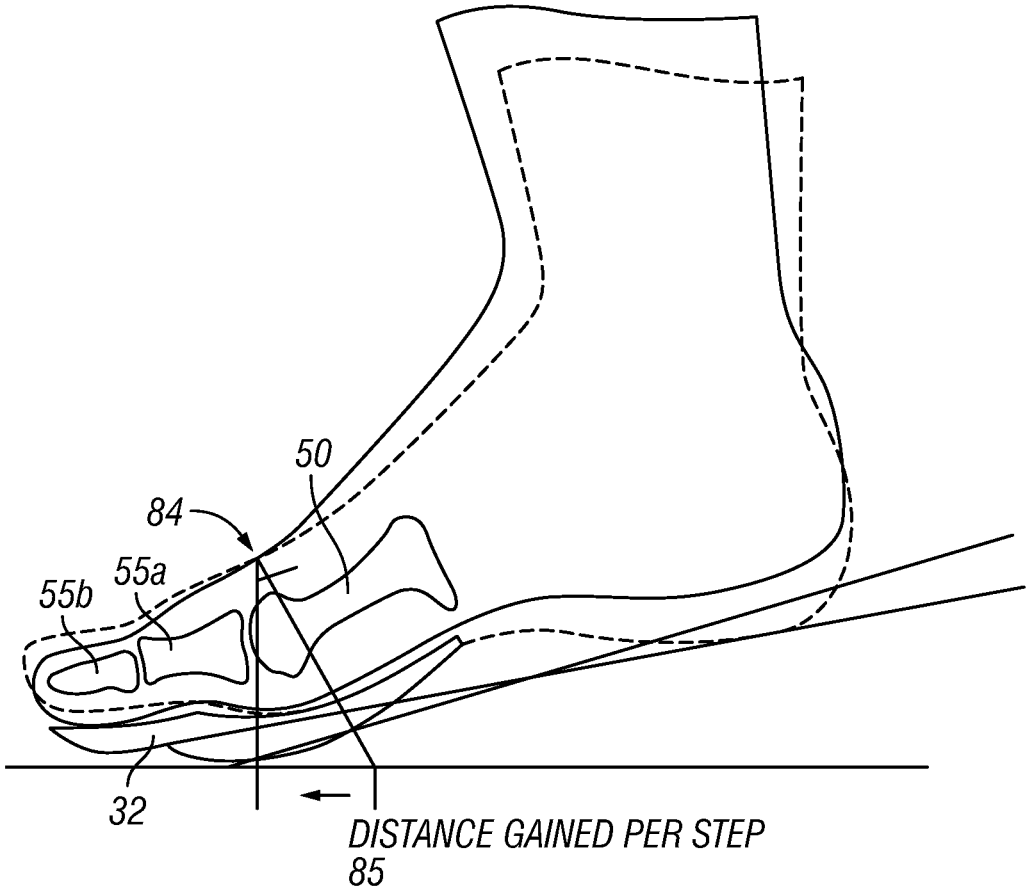
FIG. 20 shows a side sectional view of the use of the embodiment of FIG. 1, and the resulting distance gained per step.

In an embodiment of the current invention, the lower surface of the cam lever 35*a*, 34*b*, 33*a*, extends such that the relative center position of the lower portion cam lever 81, is offset distal of the plantar center point, 83, as shown in FIG. 6. Implementation of the cam lever causes the rotation path during toe-off to follow the circular path 82, along the plantar center point 83, until intersection with the lower cam lever circular path 80. Rotation then follows along the lower cam lever circular path 80. In this manner, the lower surface of the cam lever serves as an eccentric cam, with the remaining portion of the shoe and foot as follower. Accordingly, the radial rotation across the lower cam portion is transformed into linear motion relative to a fixed point 84, on the dorsal side of the foot. Therefore, an increased linear displacement 85, is gained at rotation over the lower cam surface. This increased linear displacement 85, is equivalent to the distance gained per step, as illustrated in FIGS. 6, 20.

As the individual toes articulate, the lower portion of the shoe traverses across the lower circumference of the lower cam lever. The toes are allowed to flex, and the ankle rotation is not limited. Therefore, the stride pattern is maintained during the increased linear displacement distance of the circumference of the lower cam lever.

How the Invention is Used

Implementation of the various embodiments of the current invention can be used in running, walking, jogging, or in other environments. The sole system of embodiments of the current invention is integrated into the midsole 38 of a shoe. The wearer experiences a greater distance per step and increased toe-off response.

Implementations of the various embodiments of the current invention may also assist in athletic performance. For example, sprinters or those who implement toe striking running pattern will benefit from embodiments of the current invention. The toe strike pattern will allow the foot to make contact with the ground at or near the fulcrum of the cam lever. Quick articulation of the forefoot results in an equally responsive roll towards toe-off, with an increased upward moment force on the area rear of the fulcrum.

Specific Embodiments and Examples

An example of an embodiment of the current invention is set forth in the FIGS. 1-7, and is further described as the preferred design and best mode of carrying out the invention. According to the embodiment, the sole system 31, includes an upper 36, a midsole 38, an insole 37, and an outsole 39. The cam lever 32, is integrated into the midsole 38, of the shoe. The cam lever comprises the distal longitudinally extending cam element 33, a forefoot fulcrum element 34, and proximal longitudinally extending cam element 35.

The distal longitudinally extending cam element 33, curves upwardly and distally curvilinear towards the tip of the shoe at its forward portion, and curves upwardly and proximally curvilinear towards the point of intersection with the forefoot fulcrum element 34, as shown in FIG. 7. The distal longitudinally extending cam element 33, is further subdivided into two portions: an upper distal longitudinally extending cam element, 33*b*; and a lower distal longitudinally extending cam element, 33*a*.

The upper distal longitudinally extending cam element 33*b*, extends as a concavity, such that it longitudinally extends to the tip of the shoe. The upper distal longitudinally extending cam element 33*b*, is curvilinear such that a brief recess concavity exists, extending the approximate distance of the toes. The upper distal longitudinally extending cam element 33*b*, intersects with the elevated upper convex portion, 34*a*.

The lower distal longitudinally extending cam element 33*a*, extends as a convexity, such that it extends longitudinally curvilinear, and forms a lower plantar surface of rotation, as illustrated in FIG. 7. The lower distal longitudinally extending cam element 33*a*, intersects with the recessed lower concave portion, 34*b*.

The forefoot fulcrum element 34, forms the point of intersection between the distal longitudinally extending cam element 33, and the proximal longitudinally extending cam element 35. The forefoot fulcrum element 34, allows a downward moment force applied distal to the forefoot fulcrum element 34, to mechanically provide an upward moment force proximal to the forefoot fulcrum element 34. The forefoot fulcrum element 34, includes an elevated upper convex portion 34*a*, and a recessed lower concave portion 34*b*.

The elevated upper convex portion 34*a*, is positioned such that it rests forward of the ball of the foot approximately distal of the position where the individual phalangeal bones meet the metatarsus at the metatarsophalangeal joints 60, as illustrated in FIG. 7. The elevated upper convex portion 34*a*, follows contours the outer periphery of the plantar side of the foot near the metatarsophalangeal joints 60. The elevated upper convex portion 34*a*, allows intersection of the upper distal longitudinally extending cam element 33*b*, and the upper portion of the proximal longitudinally extending cam element 35*b*, to form a convexity, as illustrated in FIG. 6.

The recessed lower concave portion 34*b*, is positioned below the elevated upper convex portion 34*a*, and allows intersection of the lower distal longitudinally extending cam element 33*a*, and the lower proximal longitudinally extending cam element 35*a*, to form a concavity, as illustrated in FIG. 7.

Figure 1:
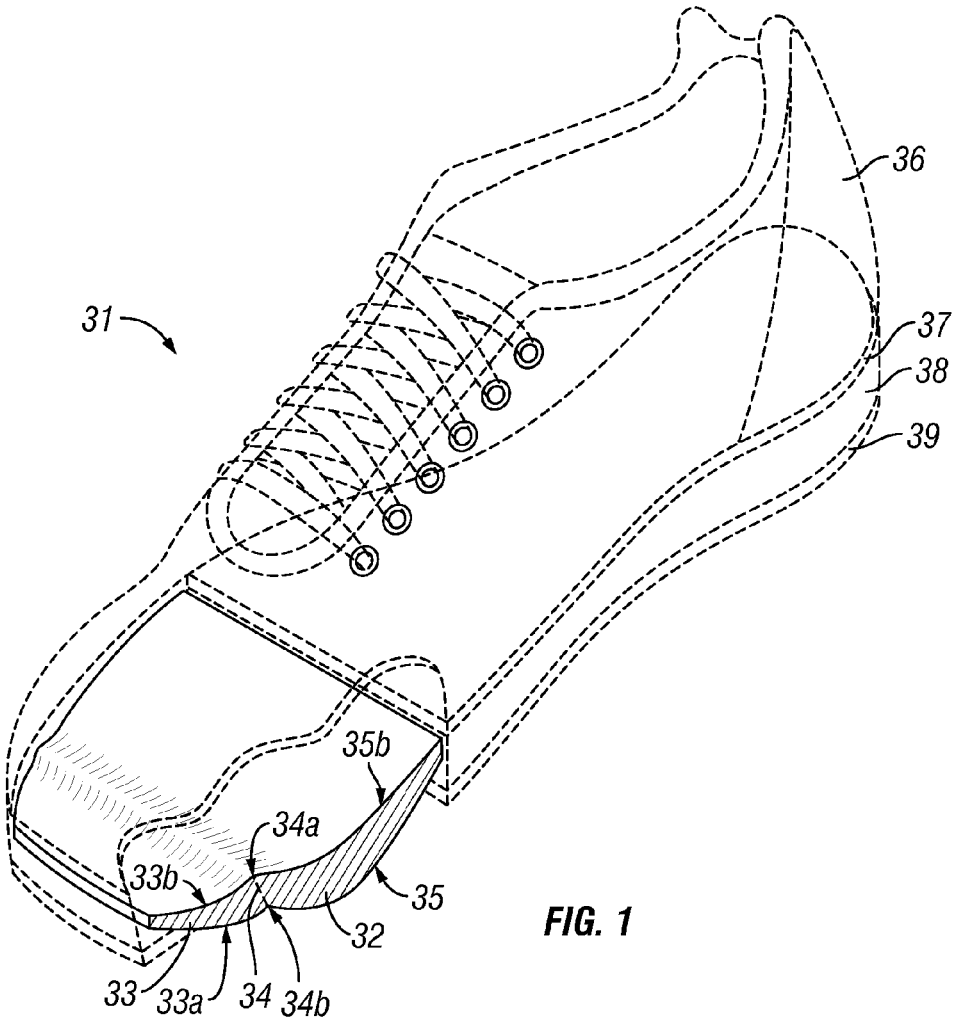
FIG. 1 shows a perspective view of an embodiment of the invention, with a sectional view of the insole, midsole, cam lever, and outsole, and a cutaway view of the forefoot region.
Figure 2:
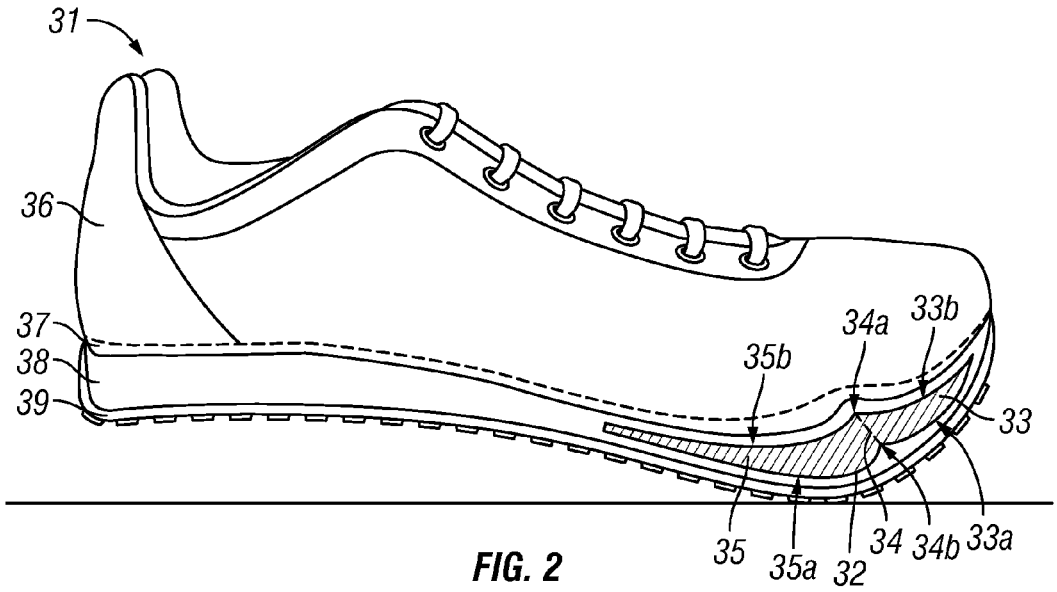
FIG. 2 shows a side view of the embodiment of FIG. 1, with a sectional view of the insole, midsole, cam lever, and outsole.
Figure 3:
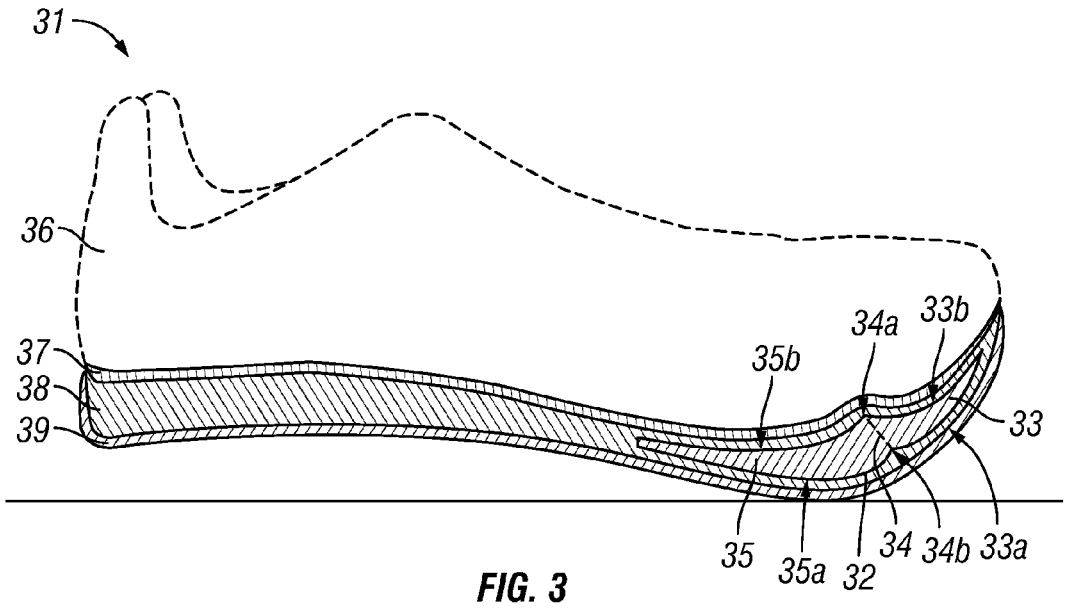
FIG. 3 shows a side sectional view of the embodiment of FIG. 1.

The proximal longitudinally extending cam element 35, exists as a longitudinally extending element, extending proximally curvilinear towards the rear of the shoe, and upwardly distal and curvilinear towards the point of intersection with the forefoot fulcrum element 34, as illustrated in FIGS. 1, 2, 3. The proximal longitudinally extending cam element 35, comprises an upper proximal longitudinally extending cam element 35*b*, and a lower proximal longitudinally extending cam element 35*a*. Both the upper and lower proximal longitudinally extending cam element 35*b*, 35*a*, extend curvilinear proximal from the intersection of the forefoot fulcrum element 34, towards the rear of the shoe, as illustrated in FIGS. 1, 2, 3.

The upper proximal longitudinally extending cam element 35*b*, exists as a concavity, proximal to the forefoot fulcrum element 34. The lower proximal longitudinally extending cam element 35*a*, extends proximally in a curvilinear manner. The lower proximal longitudinally extending cam element 35*a*, forms a lower surface of rotation, and serves as the "eccentric cam" increasing the distance per step, as shown in FIGS. 6, 20. The proximal longitudinally extending cam element 35, tapers and terminates near midfoot.

Figure 4:
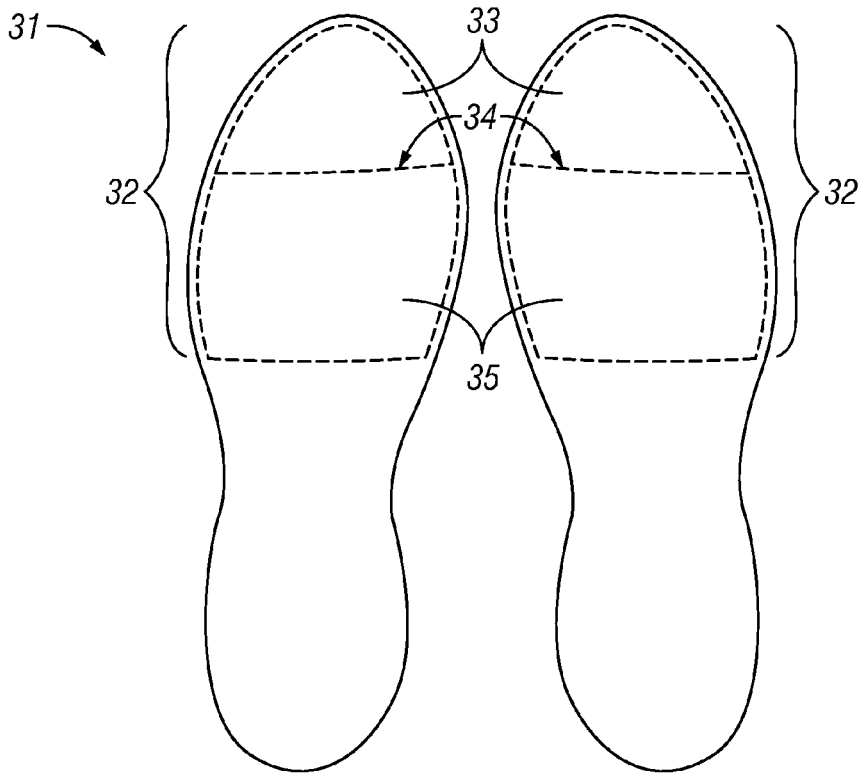
FIG. 4 shows a top view of the relative location of the cam lever in relation to the insole and path of the forefoot fulcrum element of the embodiment of FIG. 1.

A top view of the preferred embodiment of the current invention is illustrated in FIG. 4. As may be appreciated by the drawings, the cam lever 32, extends from the tip of the shoe to approximately the midfoot. The forefoot fulcrum element 34, separates the cam lever and follows the approximate path of the individual metatarsophalangeal joints 60, traversing the width of the sole, from the medial to the lateral side of the foot, as illustrated in FIG. 4.

Figure 5:
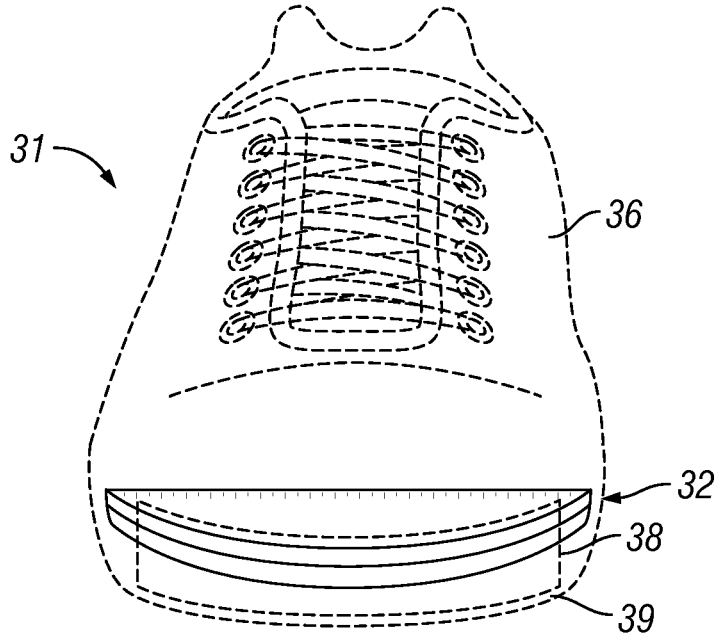
FIG. 5 shows a front sectional view of the embodiment of FIG. 1.

A front sectional view of the preferred embodiment of the current invention is illustrated in FIG. 5. As may be appreciated by the drawings, the cam lever 32, traverses from the medial to the lateral side of the foot, and forms a lower concavity for the resting portion of the foot.

According to the preferred embodiment, the shoe upper 36, is comprised of lightweight material housing the foot, similar to that of other running shoes. The upper 36, may be formed of a number of pliable materials such as cloth, rubber or rubber polymers, plastic or plastic polymers, neoprene, leather, mesh material, or a combination thereof. The insole 37, comprises a thin cushion layer, between the foot and the midsole 38. The insole 37, provides a bottom layer that the foot rests upon. In the current embodiment, the insole 37, follows the relative contours of the upper portion of the midsole 38, as shown in FIGS. 1, 2, 3. The insole 37, may be made of a soft cushioning material such as cloth, neoprene, leather, foam, or combinations thereof.

The midsole 38, of the preferred embodiment allows integration of the cam lever, 32. The individual elements of the cam lever 32, are joined together for integration into the midsole 38. The midsole 38, is a multi-density component, providing cushion and attenuation from ground forces. The midsole 38, exists between the insole 37, and the outsole 39. The insole 37, integrates the cam lever 32, such that the midsole 38, follows the outer periphery of the cam lever, as illustrated in FIGS. 1-7.

The outsole 39, of the preferred embodiment is comprised of a lightweight resilient material, and forms the portion where the shoe makes contact with the ground. The outsole 39, extends from the rear of the shoe near the heel and traverses the area of the plantar side of the foot to the tip of the shoe. The outsole 39, follows the contour of the midsole 38, as illustrated in FIGS. 1, 2, 3. The outsole 39, exists to provide traction for the wearer, and may include features such as treads or other friction enhancing surfaces, as illustrated in FIG. 1.

The midsole 38, cam lever 32, and outsole 39, of the preferred embodiment are comprised of an ethyl vinyl acetate (EVA) foam. The EVA foam of the cam 32, has greater density of the EVA foam of the midsole 38. The EVA foam of the outsole 39, has greater density than the density of the EVA foam of the midsole 38. The approximate density than the EVA foam (when measured on a density gauge) is as follows: the midsole 38, about 45; the cam lever 32, about 75; and the outsole 39, about 85. Elements of the current embodiment are joined together either by glue or by fabric stitching.

Alternatives

Figure 8:
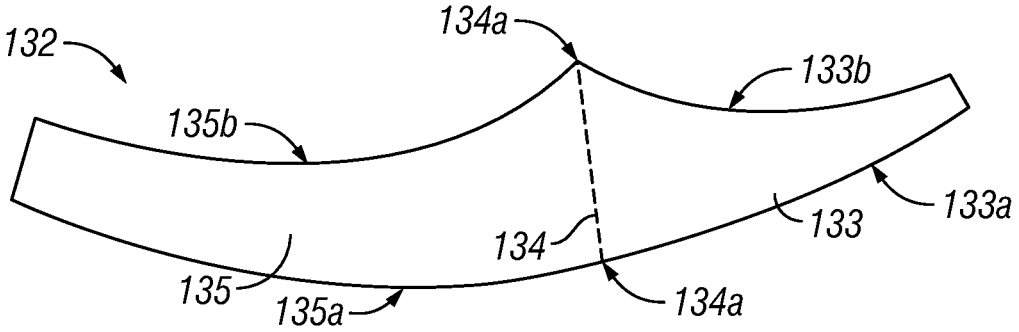
FIG. 8 shows a side view of the cam lever of an alternate embodiment of the invention, wherein the lower portion of the cam lever extends as one continuous longitudinal element.

Although the present invention has been described in considerable detail with reference to certain preferred versions thereof, other versions are possible. For example, an alternate embodiment is shown in FIG. 8. In the embodiment, the cam lever 132, and distal longitudinally extending cam element 133 differs from that of the preferred embodiment. Specifically, the lower portion of the cam lever 135*a*, 134*b*, 133*a*, may extend as one continuous longitudinal element, extending curvilinear as an arc from the tip of the shoe to approximately the midfoot, as illustrated in FIG. 8. The upper portions of the cam lever 135*b*, 134*a*, 133*b*, are of similar configuration to the respective elements set forth in the preferred embodiment.

Figure 9:
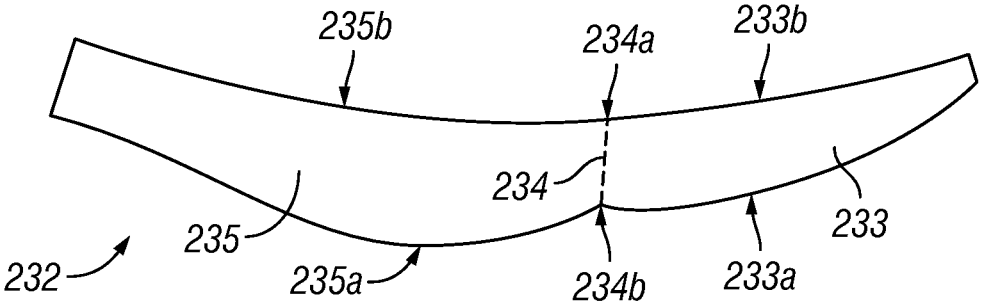
FIG. 9 shows a side view of the cam lever of an alternate embodiment of the invention, wherein the upper portion of the cam lever extends as one continuous longitudinal element.

A further embodiment is set forth according to FIG. 9, setting forth the cam lever 232 and distal longitudinally extending cam element 233. In the embodiment, the cam lever 232, and the upper portion of the cam lever 235*a*, 234*b*, 233*a*, may extend as one continuous longitudinal element, extending curvilinear from the tip of the shoe to approximately the midfoot, as illustrated in FIG. 9. The lower portion of the cam lever 235*a*, 234*b*, 233*a*, is of similar configuration to the respective elements set forth in the preferred embodiment.

Figure 10:
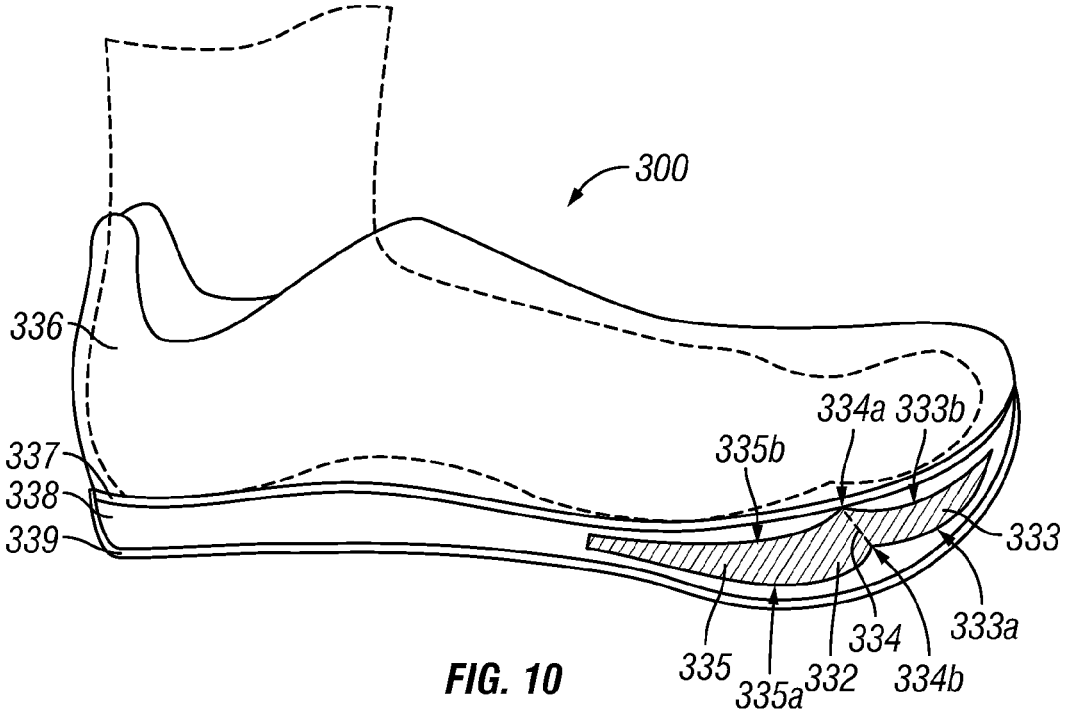
FIG. 10 shows a side view of an alternate embodiment of the invention, with a sectional view of the insole, midsole, cam lever, and outsole, wherein the insole does not follow the contours of the upper portion of the cam lever and traverses in a relatively flat manner.

A further embodiment is illustrated in FIG. 10. In the sole system 300, of the embodiment, the insole 337, does not follow the contours of the cam lever 332. Instead the insole 337, traverses in a relatively flat manner, slightly curving upward towards the tip of the shoe, as illustrated in FIG. 10. The distal longitudinally extending cam element 333, lower distal longitudinally extending cam element 333*a*, upper distal longitudinally extending cam element 333*b*, forefoot fulcrum element 334, elevated upper convex portion 334*a*, recessed lower concave portion 334*b*, proximal longitudinally extending cam element 335, lower proximal longitudinally extending cam element 335*a*, upper proximal longitudinally extending cam element 335*b*, upper 336, midsole 338, insole 337, and outsole 339 are as illustrated in FIG. 10.

Figure 11:
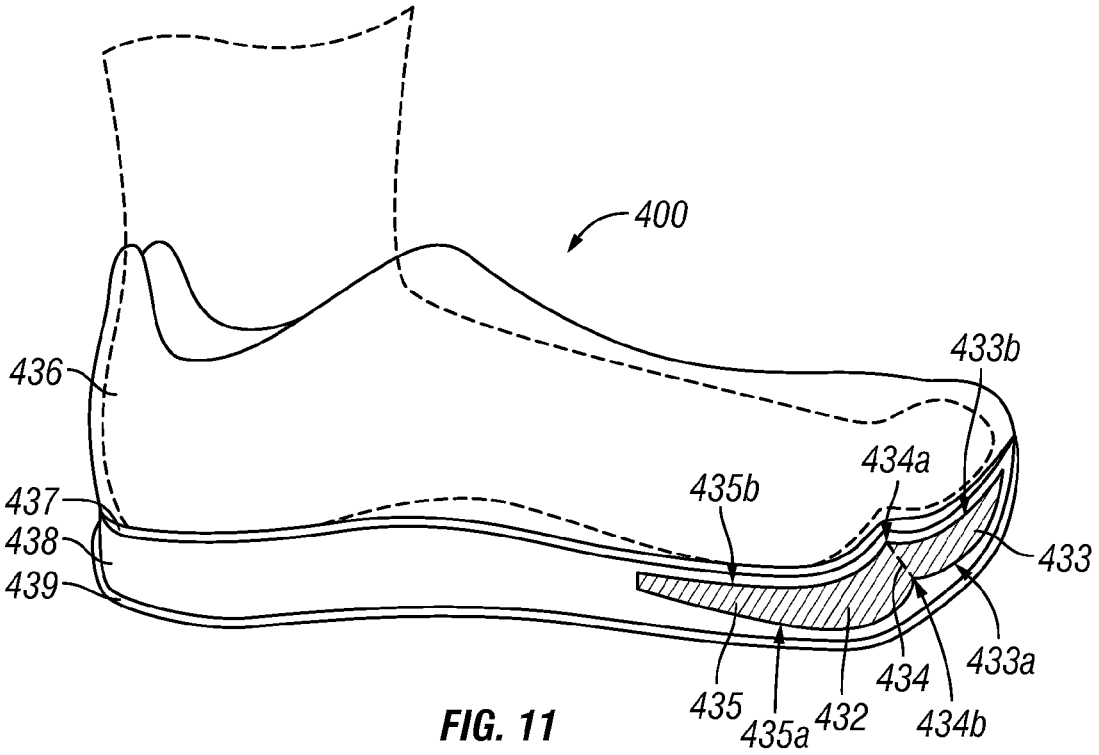
FIG. 11 shows a side view of the embodiment of an alternate embodiment of the invention, with a sectional view of the insole, midsole, cam lever, and outsole, wherein the insole and outsole do not follow the contours of the lower portion of the cam lever and traverse in a relatively flat manner.

A further embodiment is illustrated in FIG. 11. In the sole system 400, of the embodiment, the midsole 438, (and outsole 439), do not follow the contours of the lower portion of the cam lever, 435*a*, 434*b*, 433*a*. Instead, the portion of the midsole 438, nearest to the heel has an increased thickness with respect to the preferred embodiment, so that the outer convexity in the lower portion of the cam lever 432, is less pronounced, as illustrated in FIG. 11. The distal longitudinally extending cam element 433, lower distal longitudinally extending cam element 433*a*, upper distal longitudinally extending cam element 433*b*, forefoot fulcrum element 434, elevated upper convex portion 434*a*, recessed lower concave portion 434*b*, proximal longitudinally extending cam element 435, lower proximal longitudinally extending cam element 435*a*, upper proximal longitudinally extending cam element 435*b*, upper 436, midsole 438, insole 437, and outsole 439 are as illustrated in FIG. 11.

Figure 12:
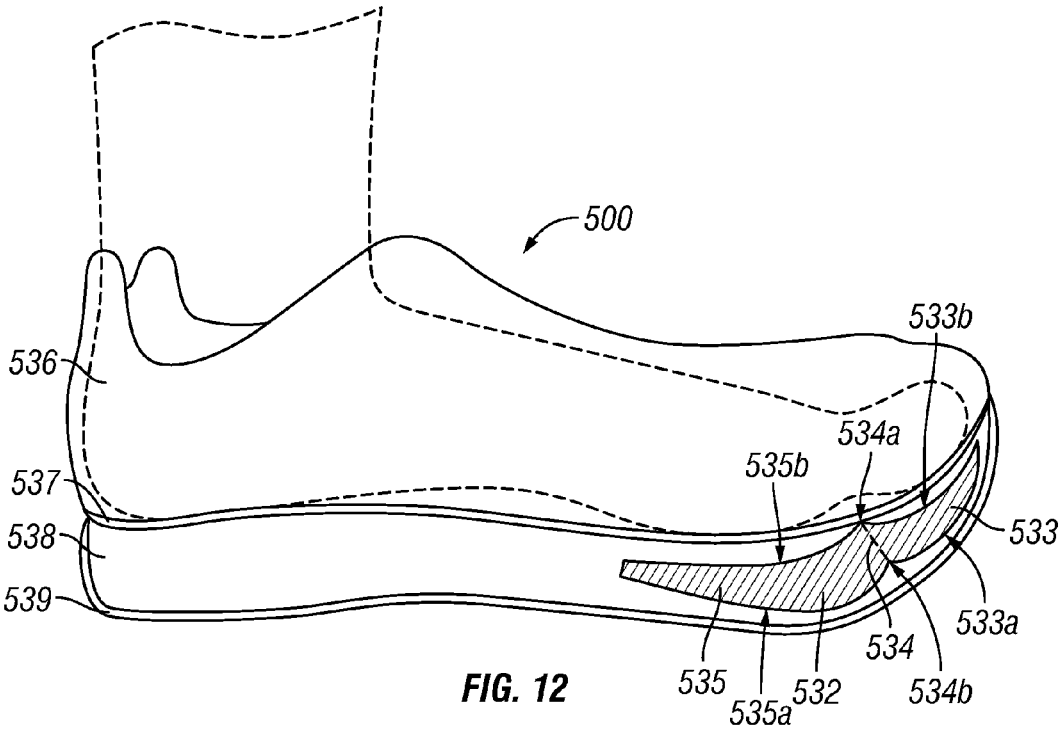
FIG. 12 shows a side view of the embodiment of an alternate embodiment of the invention, with a sectional view of the insole, midsole, cam lever, and outsole, wherein the insole does not follow the contours of the upper portion of the cam lever and traverses in a relatively flat manner, and the insole and outsole do not follow the contours of the lower portion of the cam lever and traverse in a relatively flat manner.

Additionally, a combination of both the embodiments of FIG. 10 and FIG. 11 is contemplated by embodiments of the current invention. An example of such a sole system 500, of yet another embodiment is illustrated in FIG. 12. In this embodiment, the insole 537, does not follow the contours of the cam lever 532. Instead the insole 537, traverses in a relatively flat manner, slightly curving upward towards the tip of the shoe. The midsole 538, (and outsole 539), do not follow the contours of the lower portion of the cam lever, 535*a*, 534*b*, 533*a*. Instead, the portion of the midsole 538, nearest to the heel has an increased thickness with respect to the preferred embodiment, so that the outer convexity in the lower portion of the cam lever 532, is less pronounced, as illustrated in FIG. 12. The distal longitudinally extending cam element 533, lower distal longitudinally extending cam element 533*a*, upper distal longitudinally extending cam element 533*b*, forefoot fulcrum element 534, elevated upper convex portion 534*a*, recessed lower concave portion 534*b*, proximal longitudinally extending cam element 535, lower proximal longitudinally extending cam element 535*a*, upper proximal longitudinally extending cam element 535*b*, upper 536, midsole 538, insole 537, and outsole 539 are as illustrated in FIG. 12.

In other embodiments, the individual elements may be constructed of differing densities. For example, the cam lever 32, may be of equal density as the outsole 39. Alternatively, the outsole 39, may be less dense than the cam lever 32. The elements of alternate embodiments of the current invention may have differing densities than those specified in the preferred embodiment.

In other embodiments, the individual elements may be constructed of different materials. For example, the midsole, cam lever, and outsole, may include elements or combination of elements such as carbon polymers, rubber, synthetic rubber, compressed ethyl vinyl acetate (EVA) foam, polyurethane, other materials, their functional equivalents, or combinations thereof.

Figure 13:
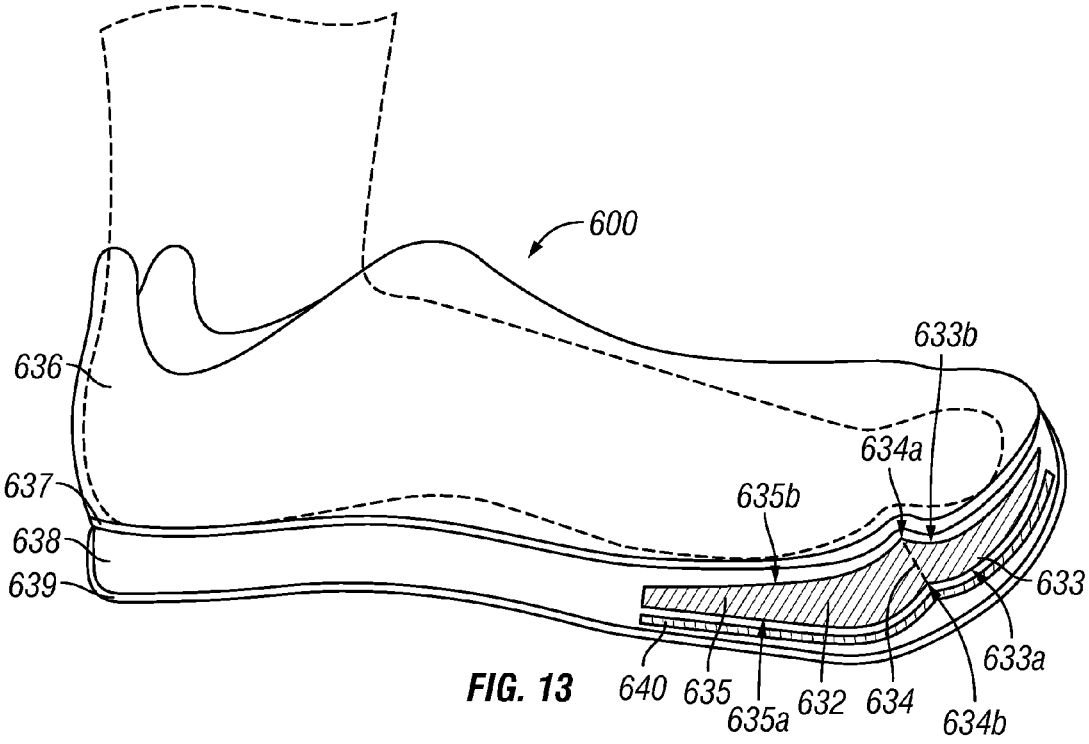
FIG. 13 shows a side view of an alternate embodiment of the invention, with a sectional view of the insole, midsole, cam lever, and outsole, wherein a resilient non-slip friction layer exists between the lower portion of the cam lever and the outsole.

A further embodiment is illustrated in FIG. 13. In the sole system 600, of the embodiment, the shoe may also comprise a non-slip friction layer 640, integrated in the midsole 638, beneath the cam lever 632. The resilient non-slip friction layer 640, is comprised of a material such as KEVLARTM, or its functional equivalent, designed to augment friction between the bottom surface of the cam lever 635*a*, 634*b*, 633*a*, and the midsole 638, or placed between the lower surface of the cam lever 635*a*, 634*b*, 633*a*, and the outsole 639, as illustrated in FIG. 13. The distal longitudinally extending cam element 633, lower distal longitudinally extending cam element 633*a*, upper distal longitudinally extending cam element 633*b*, forefoot fulcrum element 634, elevated upper convex portion 634*a*, recessed lower concave portion 634*b*, proximal longitudinally extending cam element 635, lower proximal longitudinally extending cam element 635*a*, upper proximal longitudinally extending cam element 635*b*, upper 636, midsole 638, insole 637, and outsole 639 are as illustrated in FIG. 13.

Figure 14:
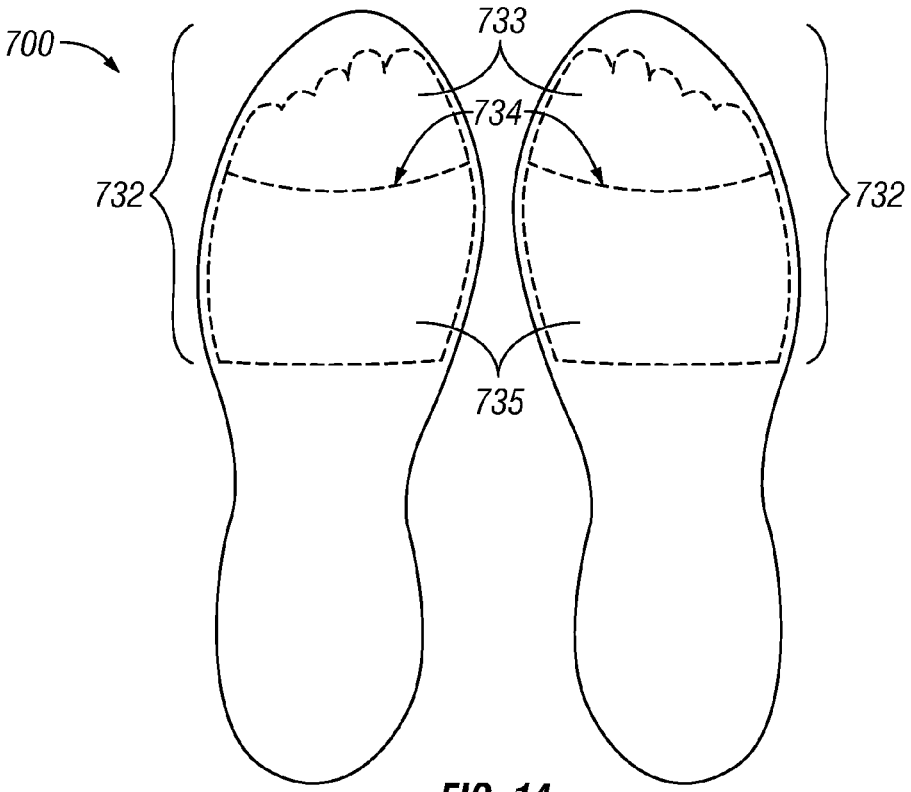
FIG. 14 shows a top view of the relative location of the cam lever in relation to the insole, path of the forefoot fulcrum element, and toe configuration of an alternate embodiment of the invention.
Figure 15:
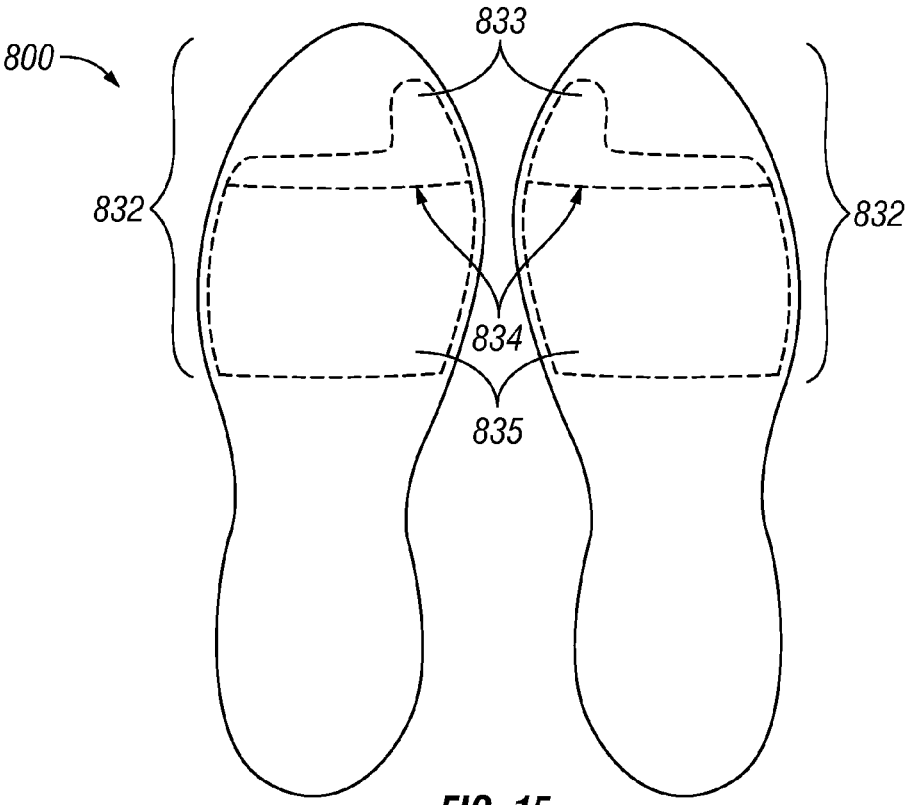
FIG. 15 shows a top view of the relative location of the cam lever in relation to the insole, path of the forefoot fulcrum element, and toe configuration of an alternate embodiment of the invention.
Figure 16:
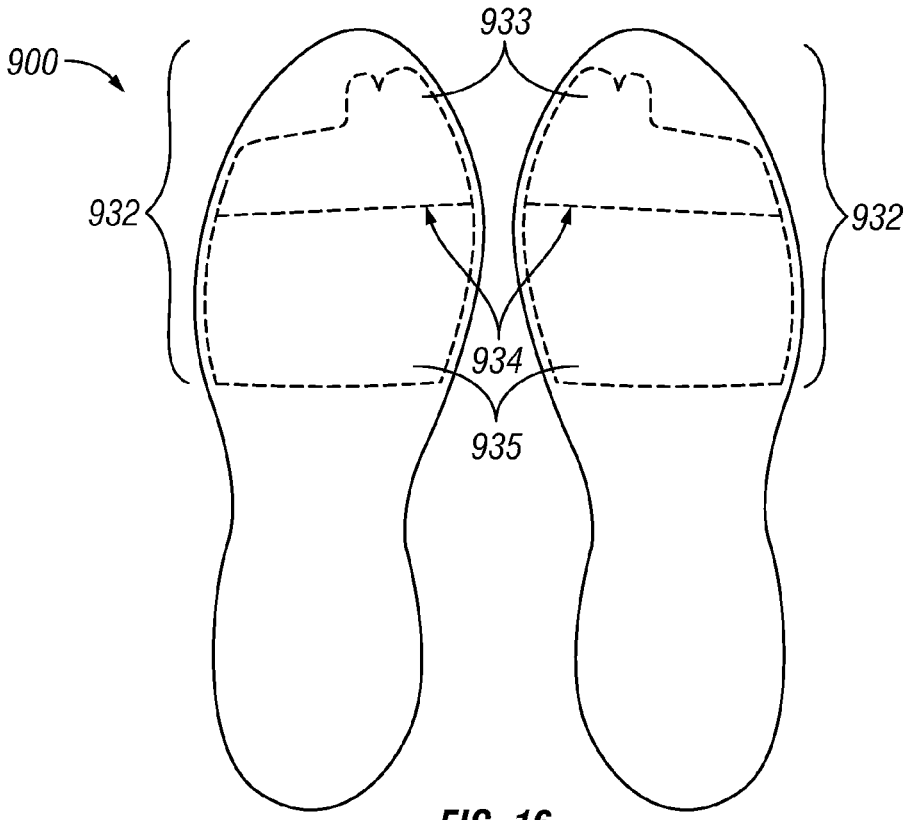
FIG. 16 shows a top view of the relative location of the cam lever in relation to the insole, path of the forefoot fulcrum element, and toe configuration of an alternate embodiment of the invention.

Further embodiments are each set forth in FIGS. 14, 15, and 16. In these embodiments, the width and toe shape configuration, and fulcrum path of the cam lever may differ (observed from a top view), as illustrated in FIGS. 14, 15, 16. For example, in the sole system 700, of the embodiment shown in FIG. 14, the cam lever 732, may be designed so that the distal longitudinally extending cam element 733, includes a resting position for each toe conformed to the shape of each toe, as illustrated in FIG. 14. The forefoot fulcrum element 734, and the proximal longitudinally extending cam element 735 are as illustrated in FIG. 14.

A further embodiment is illustrated in FIG. 15. In the sole system 800, of the embodiment, the forward longitudinally extending cam element 833, may exclude resting positions for some of the toes, as illustrated in FIG. 15. The cam lever 832, forefoot fulcrum element 834, and the proximal longitudinally extending cam element 835 are as illustrated in FIG. 15.

A further embodiment is illustrated in FIG. 16. In the sole system 900, of the embodiment, the distal longitudinally extending cam element 933 may also incorporate differing grouping of toe configurations, as shown in FIG. 16. The cam lever 932, forefoot fulcrum element 934, and the proximal longitudinally extending cam element 935 are as illustrated in FIG. 16. Additionally, a combination of the embodiments of FIGS. 14, 15, 16, allows for one or both to exist in combination. Additionally, embodiments containing resting positions for all permutations of the five toes are contemplated by the current invention. For example, embodiments of the current invention may provide resting positions for the following toe combinations: first and third toe; first and fourth toe; first and fifth toe; second and third toe; second and fourth toe; second and fifth toe; third and fourth toe; third and fifth toe; and fourth and fifth toe. Each of such permutations are contemplated by embodiments of the current invention.

Figure 17:
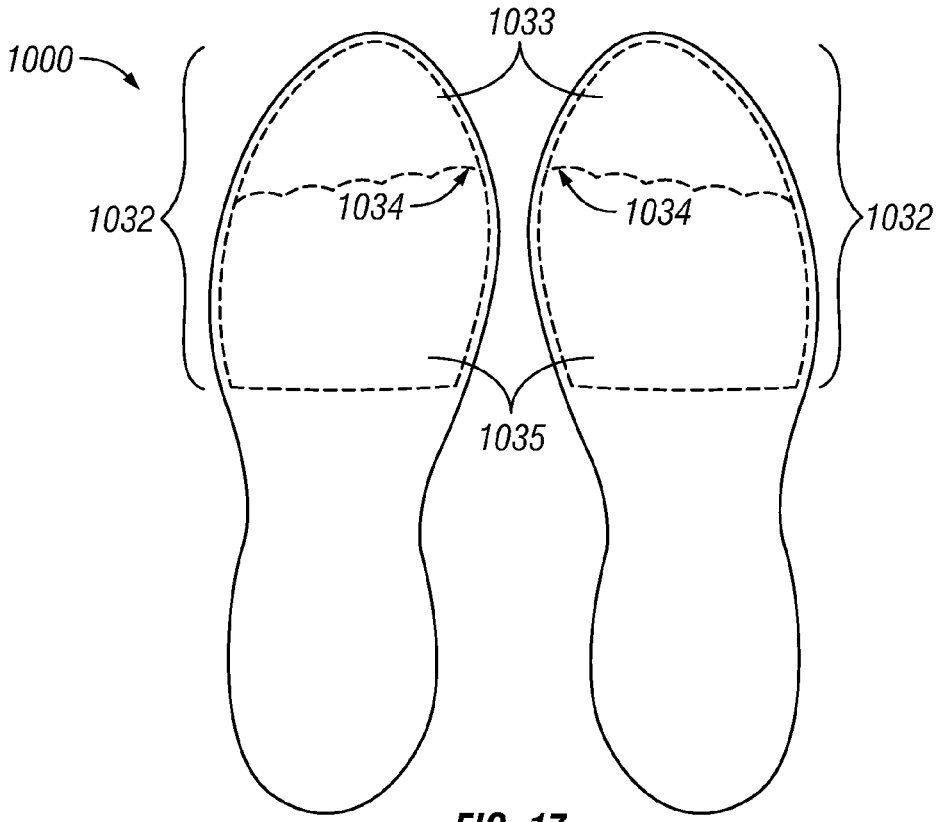
FIG. 17 shows a top view of the relative location of the cam lever in relation to the insole, path of the forefoot fulcrum element, and toe configuration of an alternate embodiment of the invention.

A further embodiment is illustrated in FIG. 17. In the sole system 1000, of the embodiment, the path of the forefoot fulcrum element 1033, may deviate to follow the contours of the lower portion of the foot nearest to the metatarsophalangeal joints 60, as illustrated in FIG. 17. The cam lever 1032, forefoot fulcrum element 1034, and the proximal longitudinally extending cam element 1035 are as illustrated in FIG. 17.

Figure 18:
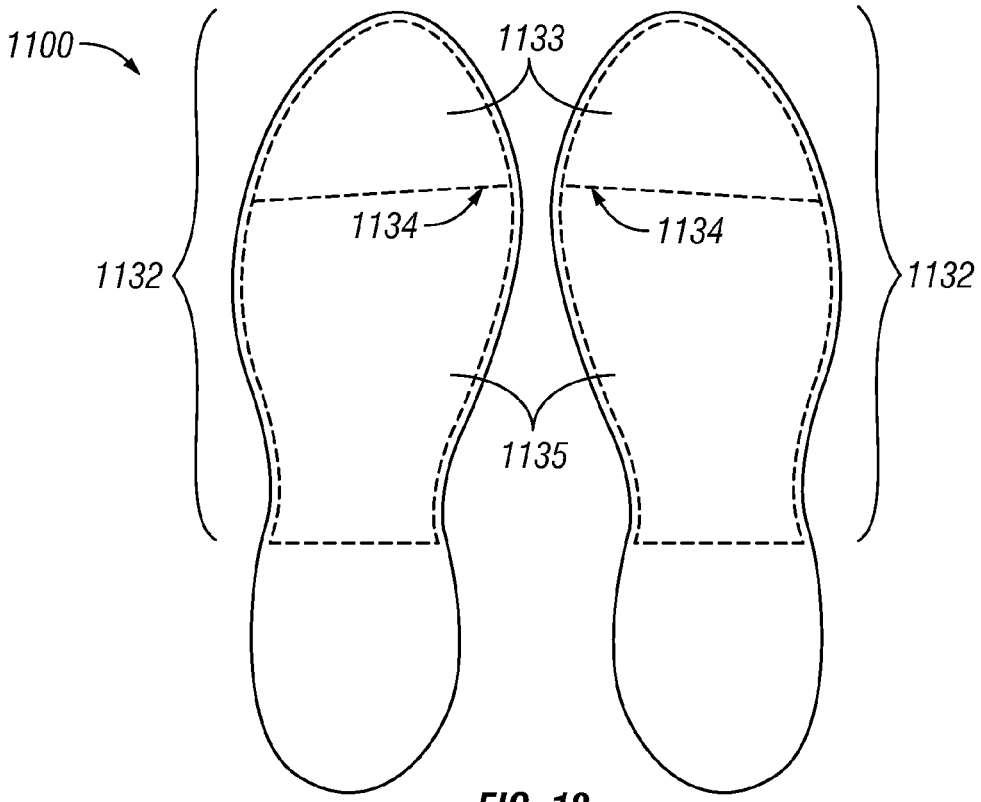
FIG. 18 shows a top view of the relative location of the cam lever in relation to the insole, path of the forefoot fulcrum element, and toe configuration of an alternate embodiment of the invention.
Figure 19:
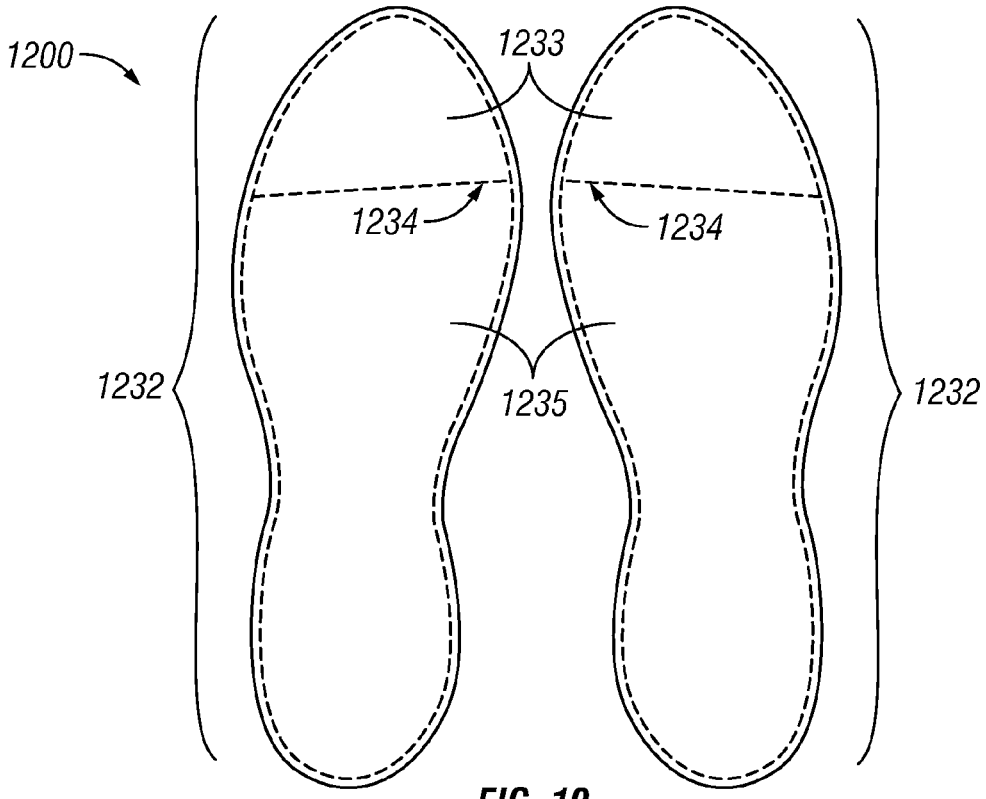
FIG. 19 shows a top view of the relative location of the cam lever in relation to the insole, path of the forefoot fulcrum element, and toe configuration of an alternate embodiment of the invention, in which the proximal longitudinally extending cam element extends to the rear of the shoe.

In alternate embodiments, the cam lever 32, may extend proximally past midfoot. For example, a further embodiment is illustrated in FIG. 18. In the sole system 1100 of the embodiment, the cam lever 1132, extends to a termination point between the midfoot and proximal end of the shoe, as illustrated in FIG. 18. The cam lever 1032, forefoot fulcrum element 1034, and the proximal longitudinally extending cam element 1035 are as illustrated in FIG. 17. In the sole system 1200, the cam lever 1232, extends to the proximal side of the shoe, as illustrated in FIG. 19.

Differing combinations and permutations of the embodiments set forth are contemplated by the current invention. Additionally, all functional equivalents of materials used and means of attachment of elements are contemplated by the current invention. Therefore, the spirit and scope of the appended claims should not be limited to the descriptions of the preferred versions and alternate embodiments set forth herein.

Any element in a claim that does not explicitly state "means for" performing a specified function, or "step for" performing a specific function, is not to be interpreted as a "means" or "step" clause as specified in 35 U.S.C. §112, ¶ 6. In particular, the use of "step of" in the claims herein is not intended to invoke the provisions of 35 U.S.C. §112, ¶ 6.

What is claimed is:

1. A sole system integrated into a shoe, comprising: a shoe upper, a midsole, an outsole, and an insole; a cam lever integrated into said midsole extending longitudinally curvilinear between said outsole and said insole in a forefoot region of said shoe; the cam lever further comprising a raised ridge configured to correspond to rest forward of the ball of the foot of a wearer, a distal longitudinally extending cam element, and a proximal longitudinally extending cam element; the cam lever having an upper surface, from which said raised ridge extends longitudinally across an entire width of said midsole; the outsole extending longitudinally curvilinear and conformed to deviate from the lower plantar surface of the wearer's foot to form an eccentric surface located at the forefoot region of the shoe, below and distal a plantar center point; wherein said cam lever has a greater density than said midsole; wherein the position of said cam lever in the forefoot region of the shoe causes said midsole to have an increased thickness in the forefoot region with respect to the rest of the midsole; and wherein rotation of said eccentric surface across the ground is transformed into linear motion relative to a fixed point on a dorsal side of the foot; and wherein downward articulation of the wearer's toes against said distal longitudinally extending cam element causes an upward moment force to be applied proximal to said raised ridge.

2. The sole system of claim 1, wherein said cam lever is comprised of one or more curvilinear convexities.

3. The sole system of claim 1, wherein said distal longitudinally extending cam element curves upwardly and distally curvilinear, and curves upwardly and proximally curvilinear towards the point of intersection with said raised ridge.

4. The sole system of claim 3, wherein said distal longitudinally extending cam element further comprises an upper distal longitudinally extending cam element, and a lower distal longitudinally extending cam element.

5. The sole system of claim 1, wherein said raised ridge forms the point of intersection between said distal longitudinally extending cam element, and said proximal longitudinally extending cam element.

6. The sole system of claim 1, wherein said raised ridge is configured to correspond to rest to the forward of the ball of the foot distal of the position configured to correspond where the individual phalangeal bones meet the metatarsus at the metatarsophalangeal joints, and follows the contours of the outer periphery configured to correspond to the plantar side of the foot near the metatarsophalangeal joints.

7. The sole system of claim 1, wherein said proximal longitudinally extending cam element exists as a longitudinally extending element, extending proximally curvilinear, and upwardly distal and curvilinear towards the point of intersection with said raised ridge.

8. The sole system of claim 7, wherein said proximal longitudinally extending cam element further comprises an upper proximal longitudinally extending cam element, and a lower proximal longitudinally extending cam element.

9. The sole system of claim 8, wherein said upper proximal longitudinally extending cam element exists as a concavity, proximal to said raised ridge.

10. The sole system of claim 1, wherein said cam lever extends from a first point to a second point within said shoe, said first point corresponding to a distal portion of a user's toes at a toe end of the shoe, said second point corresponding to a midfoot portion of the shoe.

11. The sole system of claim 1, wherein said raised ridge follows the path configured to correspond to the individual metatarsophalangeal joints, traversing the width of said shoe, configured to correspond from the medial to the lateral side of the foot.

12. The sole system of claim 1, wherein said cam lever is configured to correspond from the medial to the lateral side of the foot, and forms a lower concavity configured to conform to the plantar portion of the foot when view from a frontal perspective.

13. The sole system of claim 1, wherein said shoe upper is constructed of cloth, rubber or rubber polymers, plastic or plastic polymers, neoprene, leather, mesh material, or combinations thereof.

14. The sole system of claim 1, wherein said insole follows the relative contours of an upper portion of said midsole.

15. The sole system of claim 1, wherein said insole is constructed of cloth, neoprene, leather, foam, or combinations thereof.

16. The sole system of claim 1, wherein said outsole further comprises a friction enhancing surface.

17. The sole system of claim 1, wherein said midsole, cam lever, and outsole are comprised of ethyl vinyl acetate (EVA) foam.

18. The sole system of claim 17, wherein the EVA foam of said outsole has greater density than the density of the EVA foam of said midsole.

19. The sole system of claim 1, wherein a lower portion of said cam lever extends as one continuous longitudinal element, extending curvilinear as an arc from the tip of said shoe to the midfoot.

20. The sole system of claim 1, wherein said midsole, cam lever, and outsole, are constructed of carbon polymers, rubber, synthetic rubber, compressed ethyl vinyl acetate (EVA) foam, polyurethane, or combinations thereof.

21. The sole system of claim 1, further comprising a non-slip friction layer integrated into said midsole.

22. The sole system of claim 21, wherein said non-slip friction layer is located beneath said cam lever.

23. The sole system of claim 1, wherein said distal longitudinally extending cam element includes a resting place configured to correspond to each toe.

24. The sole system of claim 1, wherein said forward longitudinally extending cam element exclude resting configured to correspond to some of the toes.

25. The sole system of claim 24, wherein said forward longitudinally extending cam element includes a resting position configured to correspond to the following toe combinations: configured to the first and third toe; configured to the first and fourth toe; configured to the first and fifth toe; configured to the second and third toe; configured to the second and fourth toe; configured to the second and fifth toe; configured to the third and fourth toe; configured to the third and fifth toe; or configured to the fourth and fifth toe.

26. The sole system of claim 1, wherein a path of said raised ridge deviates to follow the contours configured to correspond to the lower portion of the foot nearest to the metatarsophalangeal joints.

27. A sole system comprising: a shoe having a midsole and an outsole; a cam lever integrated into said midsole; wherein said outsole has a pronounced lower region corresponding with the forefoot region of the shoe, which deviates from the natural contours corresponding with a plantar side of a wearer's foot; wherein said midsole has an increased thickness in said forefoot region of said shoe with respect to the remaining portion of said midsole; wherein said cam lever has a raised ridge on an upper surface of said cam lever, and wherein said raised ridge extends longitudinally across an entire width of said midsole; said cam lever configured within said midfoot region of said shoe such that downward force applied distal to said raised ridge returns upward force proximal to said raised ridge.

28. A sole system comprising: a shoe having a midsole, an outsole, and an insole; a cam lever integrated into said midsole; wherein said outsole has a pronounced lower region corresponding with the forefoot region of the shoe, which deviates from the natural contours corresponding with a plantar side of a wearer's foot wherein said midsole has an increased thickness in said forefoot region of said shoe with respect to the remaining portion of said midsole; wherein said cam lever has a greater density than said midsole; wherein said cam lever has a raised ridge on an upper surface of said cam lever, and wherein said raised ridge extends longitudinally across an entire width of said midsole; said cam lever configured within said midfoot region such that downward force applied distal to said raised ridge returns upward force proximal to said raised ridge.

* * * * *